US011739398B2

(12) United States Patent
Suzuki et al.

(10) Patent No.: US 11,739,398 B2
(45) Date of Patent: Aug. 29, 2023

(54) NICKEL-BASED SUPERALLOY

(71) Applicant: General Electric Company, Schenectady, NY (US)

(72) Inventors: Akane Suzuki, Ballston Spa, NY (US); Chen Shen, Schenectady, NY (US); Arthur Samuel Peck, Greer, SC (US); Shenyan Huang, Niskayuna, NY (US); Michael Douglas Arnett, Simpsonville, SC (US); Jon Conrad Schaeffer, Greenville, SC (US); Pazhayannur Ramanathan Subramanian, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 17/173,470

(22) Filed: Feb. 11, 2021

(65) Prior Publication Data

US 2022/0251686 A1 Aug. 11, 2022

(51) Int. Cl.
*C22C 19/05* (2006.01)

(52) U.S. Cl.
CPC ..... *C22C 19/056* (2013.01)

(58) Field of Classification Search
CPC ..... C22F 1/10; C22C 19/056
See application file for complete search history.

(56) References Cited

U.S. PATENT DOCUMENTS 4,388,124 A 6/1983 Henry
5,611,670 A * 3/1997 Yoshinari ..... C22C 19/056 164/122.2
6,419,763 B1 * 7/2002 Konter ..... C22C 19/056 148/404
8,876,989 B2 11/2014 O'Hara et al.
10,519,787 B2 12/2019 Harris et al.
2003/0041930 A1 * 3/2003 DeLuca ..... C22C 19/056 420/443

FOREIGN PATENT DOCUMENTS

EP 1571297 A2 9/2005
EP 2913417 A1 9/2015
GN 107034387 A 8/2017
JP H01234540 A 9/1989

OTHER PUBLICATIONS

ASM International, Materials Park, Ohio, ASM Handbook vol. 2: Properties and Selection: Nonferrous Alloys and Special-Purpose Materials "Rare Earth Metals", pp. 720-732 , Oct. 1990.*
European Search Report dated Jul. 7, 2022 for Application No. 22155087.4; pp. 8.

* cited by examiner

*Primary Examiner* — Jessee R Roe
(74) *Attorney, Agent, or Firm* — James Pemrick; Charlotte Wilson; Hoffman Warnick LLC

(57) ABSTRACT

A composition includes, by weight percent: Cobalt (Co) between about 4.5 and about 7.0; Chromium (Cr) between about 10.2 and about 11.5; Molybdenum (Mo) between about 0.5 and about 2.5; Tungsten (W) between about 4.0 and about 5.5; Rhenium (Re) between about 0 and about 1.2; Aluminum (Al) between about 6.2 and about 6.8; Tantalum (Ta) between about 4.5 and about 6.0; Titanium (Ti) between about 0 and about 0.5; Hafnium (Hf) between about 0 and about 0.5; Carbon (C) between about 0 and about 0.2; Boron (B) between about 0 and about 0.02; and the balance Nickel (Ni), and other incidental impurities.

18 Claims, 3 Drawing Sheets

Oxidation at 1000°F/540°C

Conventional alloy

Alloy of application

NICKEL-BASED SUPERALLOY

TECHNICAL FIELD

The disclosure relates generally to superalloys. More particularly, the disclosure relates to Nickel (Ni)-based superalloys that exhibit enhanced environmental resistance.

BACKGROUND

In a number of high-temperature, high-strength applications, particularly for use in industrial gas turbines, as well as engine members for aircraft, chemical plant materials, engine members for automobile such as turbocharger rotors, high temperature furnace materials and the like, high strength is needed under a high temperature operating environment, as well as enhanced environmental and oxidation resistance. In some of these applications, Nickel (Ni)-based superalloys, Cobalt (Co)-based superalloys, and Iron (Fe)-based superalloys have been used. These superalloys, such as but not limited to a Ni-based superalloys, may be strengthened by the formation of a γ' phase having an ordered face-centered cubic $L1_2$ structure: $Ni_3(Al,Ti)$. The γ' phase is used to strengthen these Ni-based superalloy materials because it has an inverse temperature dependence in which strength increases together with operating temperature, inherent ductility, and stability at elevated temperatures.

BRIEF DESCRIPTION

All aspects, examples and features mentioned below can be combined in any technically possible way.

An aspect of the disclosure provides a composition comprising, by weight percent:

a. Cobalt (Co) between about 4.5 and about 7.0;
b. Chromium (Cr) between about 10.2 and about 11.5;
c. Molybdenum (Mo) between about 0.5 and about 2.5;
d. Tungsten (W) between about 4.0 and about 5.5;
e. Rhenium (Re) between about 0 and about 1.2;
f. Aluminum (Al) between about 6.2 and about 6.8;
g. Tantalum (Ta) between about 4.5 and about 6.0;
h. Titanium (Ti) between about 0 and about 0.5;
i. Hafnium (Hf) between about 0 and about 0.5;
j. Carbon (C) between about 0 and about 0.2;
k. Boron (B) between about 0 and about 0.02; and
l. the balance Nickel (Ni), and other incidental impurities.

Another aspect of the disclosure includes any of the preceding aspects, and, wherein by weight percent Molybdenum, Tungsten, Rhenium and Tantalum are related so (Mo×2)+W+Re+Ta is approximately between about 12.5 and about 15.5.

A further aspect of the disclosure includes any of the preceding aspects, and wherein by weight percent:

a. Cobalt (Co) between about 5.0 and about 7.0;
b. Chromium (Cr) between about 10.2 and about 11.5;
c. Molybdenum (Mo) between about 1.5 and about 1.9;
d. Tungsten (W) between about 4.0 and about 5.0;
e. Rhenium (Re) between about 0.5 and about 1.2;
f. Aluminum (Al) between about 6.2 and about 6.8;
g. Tantalum (Ta) between about 4.5 and about 5.5;
h. Titanium (Ti) between about 0 and about 0.5;
i. Hafnium (Hf) between about 0 and about 0.5;
j. Carbon (C) between about 0 and about 0.2;
k. Boron (B) between about 0 and about 0.02; and
l. the balance Nickel (Ni), and other incidental impurities.

Another further aspect of the disclosure includes any of the preceding aspects, and wherein by weight percent:

a. Cobalt (Co) 6.2;
b. Chromium (Cr) 10.5;
c. Molybdenum (Mo) 1.9;
d. Tungsten (W) 4.7;
e. Rhenium (Re) 1.0;
f. Aluminum (Al) 6.4;
g. Tantalum (Ta) 5.0;
h. Titanium (Ti) 0.3;
i. Hafnium (Hf) 0.14;
j. Carbon (C) 0.04;
k. Boron (B) 0.004; and
l. the balance Nickel (Ni), and other incidental impurities.

Yet another aspect of the disclosure includes any of the preceding aspects, and wherein by weight percent, the composition includes about 20 ppm of one or more rare earth elements.

Another still further aspect of the disclosure includes any of the preceding aspects, and wherein by weight percent, the composition includes about Sulfur (S) less than 1 ppm.

Another further aspect of the disclosure includes any of the preceding aspects, and wherein by weight percent: rare earth or lanthanide elements content up to about 20 ppm.

In another aspect of the disclosure includes any of the preceding aspects, and wherein by weight percent:

a. Cobalt (Co) between about 5.9 and about 6.5;
b. Chromium (Cr) between about 10.3 and about 11;
c. Molybdenum (Mo) between about 1.75 and about 1.95;
d. Tungsten (W) between about 4.5 and about 4.9;
e. Rhenium (Re) between about 0.9 and about 1.1;
f. Aluminum (Al) between about 6.25 and about 6.5;
g. Tantalum (Ta) between about 4.8 and about 5.2;
h. Titanium (Ti) between about 0.2 and about 0.4;
i. Hafnium (Hf) between about 0.1 and about 0.2;
j. Carbon (C) between about 0.03 and about 0.1;
k. Boron (B) between about 0.003 and about 0.01; and
the balance Nickel (Ni), and other incidental impurities.

Another still aspect of the disclosure includes any of the preceding aspects, and wherein by weight percent:

a. Cobalt (Co) between about 4.5 and about 5.0;
b. Chromium (Cr) between about 10.2 and about 11.5;
c. Molybdenum (Mo) between about 2 and about 2.5;
d. Tungsten (W) between about 4 and about 5;
e. Rhenium (Re) 0.0;
f. Aluminum (Al) between about 6.2 and about 6.8;
g. Tantalum (Ta) between about 5 and about 5.5;
h. Titanium (Ti) between about 0 and about 0.5;
i. Hafnium (Hf) between about 0 and about 0.5;
j. Carbon (C) between about 0 and about 0.2;
k. Boron (B) between about 0 and about 0.02; and
l. the balance Nickel (Ni), and other incidental impurities.

Yet another aspect of the disclosure includes any of the preceding aspects, and wherein by weight percent:

a. Cobalt (Co) 5.0;
b. Chromium (Cr) 10.5;
c. Molybdenum (Mo) 2.4;
d. Tungsten (W) 4.5;
e. Rhenium (Re) 0;
f. Aluminum (Al) 6.6;
g. Tantalum (Ta) 5.2;
h. Titanium (Ti) 0.1;
i. Hafnium (Hf) 0.15;
j. Carbon (C) 0.04;
k. Boron (B) 0.004; and
l. the balance Nickel (Ni), and other incidental impurities.

In still another aspect of the disclosure includes any of the preceding aspects, and wherein by weight percent:
a. Cobalt (Co) between about 4.7 and about 5.0;
b. Chromium (Cr) between about 10.3 and about 11;
c. Molybdenum (Mo) between about 2.2 and about 2.5;
d. Tungsten (W) between about 4.2 and about 4.7;
e. Rhenium (Re) between about 0;
f. Aluminum (Al) between about 6.5-and about 6.7;
g. Tantalum (Ta) between about 5.0 and about 5.4;
h. Titanium (Ti) between about 0 and about 0.2;
i. Hafnium (Hf) between about 0.1 and about 0.2;
j. Carbon (C) between about 0.03 and about 0.1;
k. Boron (B) between about 0.003 and about 0.01; and
the balance Nickel (Ni), and other incidental impurities.

Another additional aspect of the disclosure includes any of the preceding aspects, and wherein by weight percent:
a. Cobalt (Co) between about 5.0 and about 7.0;
b. Chromium (Cr) between about 10.2 and about 11.5;
c. Molybdenum (Mo) between about 0.5 and about 1.5;
d. Tungsten (W) between about 4.5 and about 5.5;
e. Rhenium (Re) between about 0.5 and about 1;
f. Aluminum (Al) between about 6.2 and about 6.8;
g. Tantalum (Ta) between about 5 and about 6;
h. Titanium (Ti) between about 0 and about 0.5;
i. Hafnium (Hf) between about 0 and about 0.5;
j. Carbon (C) between about 0 and about 0.2;
k. Boron (B) between about 0 and about 0.02; and
l. the balance Nickel (Ni), and other incidental impurities.

Another aspect of the disclosure includes any of the preceding aspects, and wherein by weight percent:
a. Cobalt (Co) 6.6;
b. Chromium (Cr) 10.8;
c. Molybdenum (Mo) 0.8;
d. Tungsten (W) 5.0;
e. Rhenium (Re) 0.8;
f. Aluminum (Al) 6.4;
g. Tantalum (Ta) 5.8;
h. Titanium (Ti) 0.1;
i. Hafnium (Hf) 0.15;
j. Carbon (C) 0.04;
k. Boron (B) 0.004; and
l. the balance Nickel (Ni), and other incidental impurities.

Another aspect of the disclosure includes any of the preceding aspects, and wherein by weight percent:
a. Cobalt (Co) between about 6.4 and about 6.8;
b. Chromium (Cr) between about 10.6 and about 11.0;
c. Molybdenum (Mo) between about 0.7 and about 0.9;
d. Tungsten (W) between about 4.8 and about 5.2;
e. Rhenium (Re) between about 0.7 and about 0.9;
f. Aluminum (Al) between about 6.25 and about 6.55;
g. Tantalum (Ta) between about 5.6 and about 6.0;
h. Titanium (Ti) between about 0 and about 0.2;
i. Hafnium (Hf) between about 0.1 and about 0.2;
j. Carbon (C) between about 0.03 and about 0.1;
k. Boron (B) between about 0.003 and about 0.01; and
l. the balance Nickel (Ni), and other incidental impurities.

An aspect of the disclosure provides a composition comprising, by weight percent:
a. Cobalt (Co) 6.2;
b. Chromium (Cr) 10.5;
c. Molybdenum (Mo) 1.9;
d. Tungsten (W) 4.7;
e. Rhenium (Re) 1.0;
f. Aluminum (Al) 6.4;
g. Tantalum (Ta) 5.0;
h. Titanium (Ti) 0.3;
i. Hafnium (Hf) 0.14;
j. Carbon (C) 0.04;
k. Boron (B) 0.004; and
l. the balance Nickel (Ni), and other incidental impurities.

An aspect of the disclosure provides an article of manufacture, the article including a composition, the composition by weight percentage:
a. Cobalt (Co) 6.2;
b. Chromium (Cr) 10.5;
c. Molybdenum (Mo) 1.9;
d. Tungsten (W) 4.7;
e. Rhenium (Re) 1.0;
f. Aluminum (Al) 6.4;
g. Tantalum (Ta) 5.0;
h. Titanium (Ti) 0.3;
i. Hafnium (Hf) 0.14;
j. Carbon (C) 0.04;
k. Boron (B) 0.004; and
l. the balance Nickel (Ni), and other incidental impurities.

Another aspect of the disclosure includes any of the preceding aspects, and wherein the article includes a turbomachinery hot gas path component selected from the group including at least one of turbine blades; turbine nozzles; casings; housings; compressor parts; shrouds; vanes; diaphragms; combustion liners, parts, and transition pieces.

An aspect of the disclosure provides making an article having high-temperature strength, oxidation resistance and corrosion resistance, comprising forming a nickel based alloy, the nickel based alloy including, in weight percent:
a. Cobalt (Co) 6.2;
b. Chromium (Cr) 10.5;
c. Molybdenum (Mo) 1.9;
d. Tungsten (W) 4.7;
e. Rhenium (Re) 1.0;
f. Aluminum (Al) 6.4;
g. Tantalum (Ta) 5.0;
h. Titanium (Ti) 0.3;
i. Hafnium (Hf) 0.14;
j. Carbon (C) 0.04;
k. Boron (B) 0.004; and
l. the balance Nickel (Ni), and other incidental impurities.
forming an article from the nickel based alloy.

Another aspect of the disclosure includes any of the preceding aspects, and wherein forming the article includes forming a turbomachinery hot gas path component, the turbomachinery hot gas path component selected from the group including at least one of turbine blades; turbine nozzles; casings; housings; compressor parts; shrouds; vanes; diaphragms; combustion liners, parts, and transition pieces.

Two or more aspects described in this disclosure, including those described in this summary section, may be combined to form implementations not specifically described herein.

The details of one or more implementations are set forth in the accompanying drawings and the description below. Other features, objects and advantages will be apparent from the description and drawings, and from the claims.

The nickel based alloy, includes, in weight percent: Cobalt (Co) between about 4.5 and about 7.0; Chromium (Cr) between about 10.2 and about 11.5; Molybdenum (Mo) between about 0.5 and about 2.5; Tungsten (W) between about 4.0 and about 5.5; Rhenium (Re) between about 0 and about 1.2; Aluminum (Al) between about 6.2 and about 6.8; Tantalum (Ta) between about 4.5 and about 6.0; Titanium (Ti) between about 0 and about 0.5; Hafnium (Hf) between about 0 and about 0.5; Carbon (C) between about 0 and about 0.2; Boron (B) between about 0 and about 0.02; and the balance Nickel (Ni), and other incidental impurities.

The illustrative aspects of the present disclosure are designed to solve the problems herein described and/or other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

Figure 1:
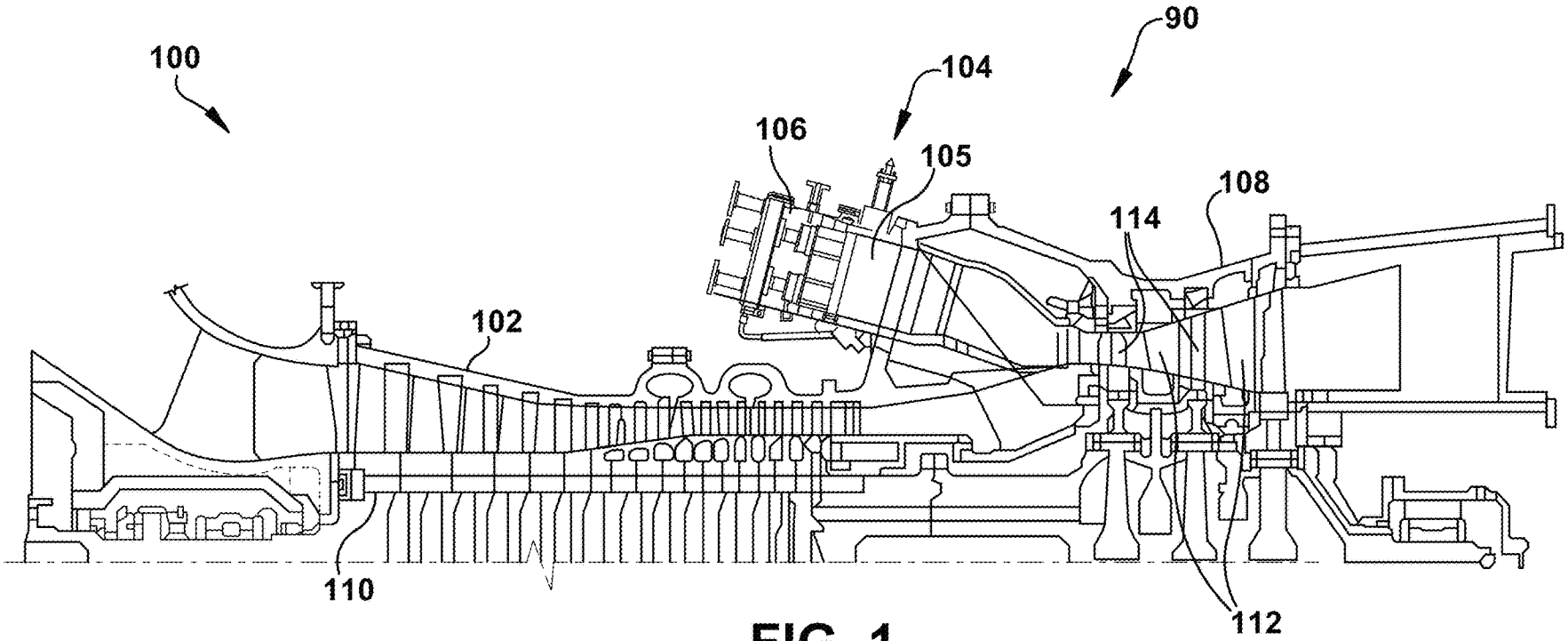
FIG. 1 illustrates a gas turbine engine with locations where blades of the instant embodiments may be employed.

It is noted that the drawings of the disclosure are not necessarily to scale. The drawings are intended to depict only typical aspects of the disclosure and therefore should not be considered as limiting the scope of the disclosure. In the drawings, like numbering represents like elements between the drawings.

DETAILED DESCRIPTION

As an initial matter, in order to clearly describe the subject matter of the current disclosure, it will become necessary to select certain terminology when referring to and describing relevant material, material compositions, and related material constituents, such as those materials used within a turbine system. To the extent possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

In addition, several descriptive terms may be used regularly herein, as described below. The terms "first", "second", and "third" may be used interchangeably to distinguish one component from another and are not intended to signify location or importance of the individual components.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components but do not preclude the presence or addition of one or more other features, integers, steps, operations, elements, components, and/or groups thereof. "Optional" or "optionally" means that the subsequently described event or circumstance may or may not occur or that the subsequently describe component or element may or may not be present, and that the description includes instances where the event occurs or the component is present and instances where it does not or is not present.

Where an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Components located in a high temperature section (also known as "hot gas path") of a gas turbine, are typically formed of superalloys. These superalloys generally include Nickel (Ni)-based superalloys, Iron (Fe)-based superalloys, Cobalt (Co)-based superalloys, and combinations thereof.

Figure 2:
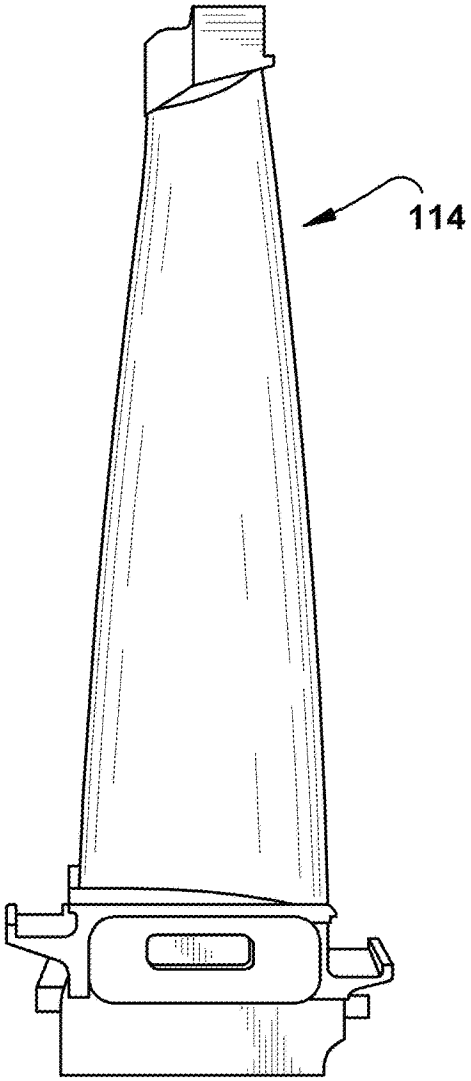
FIG. 2 illustrates an example of a blade that can be fabricated from a superalloy of the embodiments.

With reference to FIGS. 1 and 2, a turbomachine 90 in the form of a combustion turbine or gas turbine (GT) system 100 (hereinafter 'GT system 100') is illustrated. GT system 100 includes a compressor 102 and a combustor 104. Combustor 104 includes a combustion region 105 and a fuel nozzle assembly 106. In one embodiment, GT system 100 is a 7HA.03 engine, commercially available from General Electric Company, Schenectady, N.Y. A set of stationary vanes or nozzles 112 cooperate with a set of rotating blades 114 to form each stage of turbine 108, and to define a portion of a flow path through turbine 108.

Different hot gas path sections of the gas turbine system 100 may experience different operating conditions requiring materials forming components therein to have different properties. In fact, different components in the same sections may experience different operating conditions requiring different materials. Moreover, different locations in one component may experience different temperature and stress conditions.

Turbine blades 114 or airfoils in the turbine section of the engine are attached to turbine wheels and rotate at very high speeds in the hot exhaust combustion gases expelled by turbine 108. These blades or airfoils must be oxidation-resistant and corrosion-resistant, maintaining their microstructure at elevated operating temperatures while maintaining mechanical properties, such as creep resistance/stress rupture, strength, and ductility, for example and in no manner limiting of the embodiments, in a wide range of temperatures extending from below 1000° F. to over 2000° F. Because these blades have complex shapes, in order to reduce costs, they may be formed by an appropriate manner, such as casting, additively manufacturing, forging, or other suitable processes that reduce processing time as well as machining time to achieve complex shapes.

Nickel-based superalloys have been used for hot gas path components as they provide desired properties that withstand operating conditions of the turbine. Nickel-based superalloys have high temperature capabilities and strength from precipitation strengthening mechanisms that include gamma prime (γ') precipitates. Gamma prime (γ') is $Ni_3(Al, Ti)$ and a primary strengthening phase in nickel-based superalloys.

Nickel (Ni)-based superalloys, as embodied by the disclosure and including compositions as in the ranges and amounts herein, are useful in hot gas path sections of turbines since they can provide desired properties that withstand operating conditions of the gas turbine's harsh environment. The Nickel (Ni)-based superalloys, as embodied by the disclosure and including compositions as in the ranges and amounts herein, can be provided as Nickel (Ni)-based single-crystal alloy compositions. Also, aspects as embodied by the disclosure, superalloys for components may also include those superalloys made by directional solidification (columnar grain structure), equiaxed casting, additive manufacturing, wrought processes, powder metallurgy, and other processes know known or hereinafter developed. These Nickel (Ni)-based single crystal compositions possess advantageous environmental resistance at both low and high temperatures. The Nickel (Ni)-based single crystal alloys can be used for hot gas path components to extend their service life. Examples of such hot gas path components, include but are not limited to, gas turbine blades.

Accordingly, the Nickel (Ni)-based single crystal compositions, as embodied by the disclosure, enable improved and extended component life, such as hot gas path turbine components; alloy compositions designed for environmental capability requirements in a wide temperature range for gas turbines that do not reduce beneficial mechanical properties. Also, as embodied by the disclosure, the Nickel (Ni)-based single crystal compositions have a low Rhenium content (≤1%), when compared to Rene N5 (3%).

The Nickel (Ni)-based compositions, as embodied by the disclosure, contain limited amounts of Titanium (Ti) and Molybdenum (Mo) to reduce their negative effects on oxidation resistance at high temperatures (up to about 2200° F./1200° C.). Nickel (Ni)-based compositions, as embodied by the disclosure, also contain Cr greater than 10% and Al greater than 6% to achieve enhanced environmental resistance in a wide temperature range from low temperature (about 1000° F./about 540° C.) to high temperature (up to about 2200° F./about 1200° C.). The elemental contents of refractory elements (Mo, W, Re, Ta) are balanced to achieve sufficient mechanical properties from room temperature (RT) to about 1800° F./about 980° C.) and long term phase stability for minimizing formation of topologically closed packed phases that may negatively affect high temperature mechanical properties.

Figure 3:
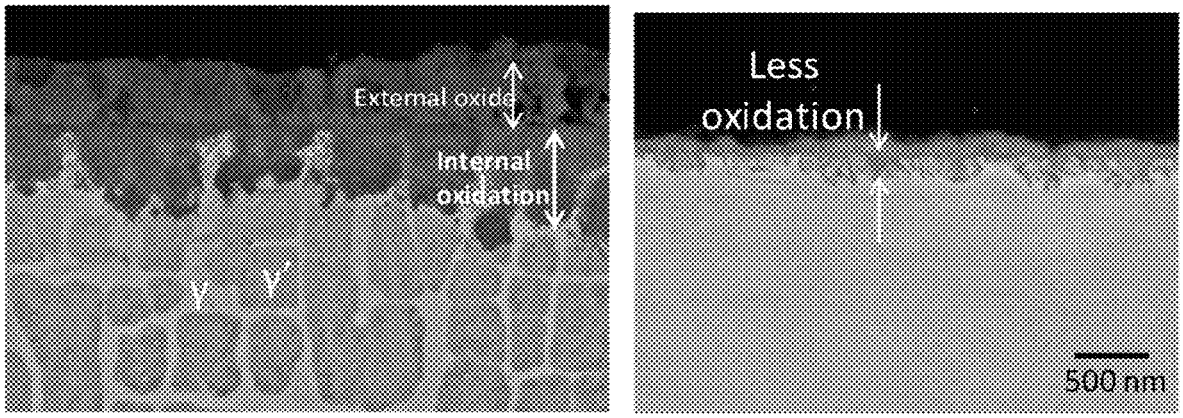
FIG. 3 is a side-by-side comparison of internal and external oxidation in a conventional Nickel (Ni)-based superalloy, and Nickel (Ni)-based superalloy, as embodied by the disclosure.

FIG. 3 illustrates a side-by-side comparison of a conventional Ni-based superalloy on the left compared to a Nickel (Ni)-based superalloy, as embodied by the disclosure. The conventional alloy (second generation Ni-based single crystal superalloy) and the Nickel (Ni)-based superalloy, as embodied by the disclosure have been subject to temperatures of about 1000° F./about 540° C. for similar time exposures. As is visible in the conventional alloy on the left, significant internal and external oxidation layers are generated at about 1000° F./about 540° C., while a Nickel (Ni)-based superalloy, as embodied by the disclosure has significantly less internal and external oxidation about 1000° F./about 540° C. for similar time exposures.

Nickel (Ni)-based superalloys, as embodied by the disclosure, have excellent environmental resistance at both low (about 1000° F./about 540° C.) and high (up to about 2200° F./about 1200° C.) temperatures. Known Nickel (Ni)-based superalloys currently employed for gas turbine blades may not exhibit such resistance over a wide range of temperatures at which a hot gas path turbine component may be subject to throughout operation, because they were generally designed to possess high temperature environmental resistance and mechanical properties by increasing contents of Al and other strengthening elements, such as Mo, W, Re, Ta, by reducing Cr content. Accordingly, Nickel (Ni)-based superalloys, which have a composition as embodied by the disclosure, have excellent environmental resistance over operating temperatures for gas turbine applications, which will include high efficiency gas turbines, such as but not limited to the H and HA gas turbines of General Electric Company of Schenectady, N.Y.

In an aspect of the embodiments, a nickel-based superalloy composition is provided. The nickel-based superalloy composition includes, by approximate weight percent constituents: Cobalt (Co) 6.2; Chromium (Cr) 10.5; Molybdenum (Mo) 1.9; Tungsten (W) 4.7; Rhenium (Re) 1.0; Aluminum (Al) 6.4; Tantalum (Ta) 5.0; Titanium (Ti) 0.3; Hafnium (Hf) 0.14; Carbon (C) 0.04; Boron (B) 0.004; and the balance Nickel (Ni), and other incidental impurities.

In another aspect of the embodiments, a nickel-based superalloy composition is provided. The nickel-based superalloy composition includes, by approximate weight percent constituents: Cobalt (Co) between about 4.5 and about 7.0; Chromium (Cr) between about 10.2 and about 11.5; Molybdenum (Mo) between about 0.5 and about 2.5; Tungsten (W) between about 4.0 and about 5.5; Rhenium (Re) between about 0 and about 1.2; Aluminum (Al) between about 6.2 and about 6.8; Tantalum (Ta) between about 4.5 and about 6.0; Titanium (Ti) between about 0 and about 0.5; Hafnium (Hf) between about 0 and about 0.5; Carbon (C) between about 0 and about 0.2; Boron (B) between about 0 and about 0.02; and the balance Nickel (Ni), and other incidental impurities. Further, the amounts of Molybdenum, Tungsten, Rhenium and Tantalum are related so (Mo×2)+W+Re+Ta is approximately between about 12.5 and about 15.5.

Another embodiment of the disclosure, a nickel-based superalloy composition is provided. The nickel-based superalloy composition includes, by approximate weight percent constituents: Cobalt (Co) between about 5.0 and about 7.0; Chromium (Cr) between about 10.2 and about 11.5; Molybdenum (Mo) between about 1.5 and about 1.9; Tungsten (W) between about 4.0 and about 5.0; Rhenium (Re) between about 0.5 and about 1.2; Aluminum (Al) between about 6.2 and about 6.8; Tantalum (Ta) between about 4.5 and about 5.5; Titanium (Ti) between about 0 and about 0.5; Hafnium (Hf) between about 0 and about 0.5; Carbon (C) between about 0 and about 0.2; Boron (B) between about 0 and about 0.02; and the balance Nickel (Ni), and other incidental impurities. Further, the amounts of Molybdenum, Tungsten, Rhenium and Tantalum are related so (Mo×2)+W+Re+Ta is approximately between about 12.5 and about 15.5.

Yet another embodiment of the disclosure, a nickel-based superalloy composition is provided. The nickel-based superalloy composition includes, by approximate weight percent constituents: Cobalt (Co) between about 4.5 and about 5.0; Chromium (Cr) between about 10.2 and about 11.5; Molybdenum (Mo) between about 2 and about 2.5; Tungsten (W) between about 4 and about 5; Rhenium (Re) 0.0; Aluminum (Al) between about 6.2 and about 6.8; Tantalum (Ta) between about 5 and about 5.5; Titanium (Ti) between about 0 and about 0.5; Hafnium (Hf) between about 0 and about 0.5; Carbon (C) between about 0 and about 0.2; Boron (B) between about 0 and about 0.02; and the balance Nickel (Ni), and other incidental impurities. Further, the amounts of Molybdenum, Tungsten, Rhenium and Tantalum are related so (Mo×2)+W+Re+Ta is approximately between about 12.5 and about 15.5.

A further embodiment of the disclosure provides a nickel-based superalloy composition that includes, by approximate weight percent constituents: Cobalt (Co) 5.0; Chromium (Cr) 10.5; Molybdenum (Mo) 2.4; Tungsten (W) 4.5; Rhenium (Re) 0.0; Aluminum (Al) 6.6; Tantalum (Ta) 5.2;

Titanium (Ti) 0.1; Hafnium (Hf) 0.15; Carbon (C) 0.04; Boron (B) 0.004; and the balance Nickel (Ni), and other incidental impurities.

A further embodiment of the disclosure provides a nickel-based superalloy composition that includes, by approximate weight percent constituents: Cobalt (Co) 6.6; Chromium (Cr) 10.8; Molybdenum (Mo) 0.8; Tungsten (W) 5.0; Rhenium (Re) 0.8; Aluminum (Al) 6.4; Tantalum (Ta) 5.8; Titanium (Ti) 0.1; Hafnium (Hf) 0.15; Carbon (C) 0.04; Boron (B) 0.004; and the balance Nickel (Ni), and other incidental impurities.

Yet another embodiment of the disclosure, a nickel-based superalloy composition is provided. The nickel-based superalloy composition includes, by approximate weight percent constituents: Cobalt (Co) between about 5.0 and about 7.0; Chromium (Cr) between about 10.2 and about 11.5; Molybdenum (Mo) between about 0.5 and about 1.5; Tungsten (W) between about 4.5 and about 5.5; Rhenium (Re) between about 0.5 and about 1.0; Aluminum (Al) between about 6.2 and about 6.8; Tantalum (Ta) between about 5 and about 6; Titanium (Ti) between about 0 and about 0.5; Hafnium (Hf) between about 0 and about 0.5; Carbon (C) between about 0 and about 0.2; Boron (B) between about 0 and about 0.02; and the balance Nickel (Ni), and other incidental impurities. Further, the amounts of Molybdenum, Tungsten, Rhenium and Tantalum are related so (Mo×2)+W+Re+Ta is approximately between about 12.5 and about 15.5.

Further aspects as embodied by the disclosure, provide any one of the compositions set forth in the embodiments to include a Sulfur (S) content being less than 1 ppm in weight percent. The sulfur at less than 1 ppm weight percent can be provided in any of the above compositional superalloys, as embodied by the disclosure.

A still further aspect of the embodiments of the disclosure include providing any one of the compositions set forth herein with a rare earth or lanthanide content up to about 20 ppm by weight percent. As defined here, rare earth elements include lanthanides and scandium and yttrium. The rare earth content, as embodied by the disclosure, can include one or more rare earth element constituents.

Nickel (Ni)-based superalloys, as embodied by the disclosure, can provide desired physical and metallurgical properties that satisfy demanding operating conditions of hot gas path components in gas turbines. Sections of the turbine where Nickel (Ni)-based superalloys, according the embodiments, may be applied include, but are not limited to, hot gas path components including turbine blades; turbine nozzles; casings; housings; compressor parts; shrouds; vanes; diaphragms; combustion liners, parts, and transition pieces, and the like, especially subject to high operating temperatures and/or harsh environments.

Additionally, Nickel (Ni)-based superalloys, as embodied by the disclosure and including compositions as in the ranges and amounts herein, can be used in a multitude of manufacturing processes to form articles of manufacture. Processes that can use Nickel (Ni)-based superalloys to form articles of manufacture, as embodied by the disclosure, include but are not limited to, additive manufacturing; directional solidification to form single-crystal grain or columnar grain structures; casting; forging; vacuum melting, such as vacuum arc remelting; welding, brazing, bonding, soldering, or joining; use a repair filler material, coupon, plug, and/or wire fill; 3D printing where Nickel (Ni)-based superalloys, as embodied herein, are provided in a powder or granular form; hot isostatic press processes; powder metallurgical processes; binder jet processes, and other processes now known or hereafter later developed.

Moreover, Nickel (Ni)-based superalloys, as embodied by the disclosure and including compositions as in the ranges and amounts herein, can be provided for use in various forms, which may facilitate application and/or use. For example, and in no way limiting of the disclosure's embodiments, Nickel (Ni)-based superalloys can be provided as a raw forging, billet, ingot, powdered superalloy material, wire form, pelletized, or any other appropriate form now known or hereafter later developed.

Additionally, dependent on processing applied to Nickel (Ni)-based superalloys, as embodied by the disclosure, can be Nickel (Ni)-based superalloys articles formed with equiaxed, directionally solidified, and single-crystal grain orientations, or any other form now known or hereafter later developed.

Al and Ti increase the volume fraction of gamma prime (γ') in the superalloy of the disclosure. Increasing volume fraction of gamma prime (γ') increases the creep resistance of the superalloy. The strength of the superalloy increases with increasing Al+Ti.

Moreover, Al increases the high temperature oxidation resistance of nickel-based superalloys. Having sufficient level of Al, greater than 6%, is critical to enable protective alumina oxide formation, in accordance with embodiments herein. However, Ti is detrimental to high temperature environmental resistance above 2000° F., and the level of its addition has to be minimized to balance the environmental resistance and mechanical properties.

Co is added and is believed to improve the stress and creep-rupture properties of Nickel (Ni)-based superalloys, in accordance with embodiments herein.

Cr increases the oxidation and hot corrosion resistance of Nickel (Ni)-based superalloys, in accordance with embodiments herein. Having sufficient level of Cr, greater than 10%, is critical for forming chromia oxide essential for low temperature environmental resistance. Cr also contributes to alumina oxide formation at high temperatures for high temperature environmental resistance. Cr is also believed to contribute to solid solution strengthening of Nickel (Ni)-based superalloys, in accordance with embodiments herein, at high temperatures and improved creep-rupture properties.

C contributes to improved creep-rupture properties of Nickel (Ni)-based superalloys, in accordance with embodiments herein. C interacts with Cr, and possibly other elements, to form carbides in interdendritic regions and on grain boundaries.

Ta, W, Mo, and Re are higher melting refractory elements that improve creep-rupture resistance. These elements may contribute to solid solution strengthening of the γ matrix. Re and W reduce diffusivity of elements, and moreover, Re segregates to interfaces between gamma (γ) and gamma prime (γ') precipitates, thereby extending the amount of time required for coarsening of gamma prime (γ') improving high temperature properties such as creep-rupture. Ta and W also may substitute for Ti in formation of gamma prime (γ') in Nickel (Ni)-based superalloys, in accordance with embodiments herein. High amount of Mo improves mechanical properties, but negatively affects the environmental resistance at high temperatures.

Hf and B can be added in small weight percentages to Nickel (Ni)-based superalloys to provide grain boundary strengthening. Boron contributes to formation of borides, and Hafnium contributes to formation of carbides and gamma prime precipitates.

Creep strength at gas turbine operating temperatures is related to gamma prime (γ') amount, and operating temperatures are affected by the γ' solvus temperature. The γ' solvus temperature is the temperature at which gamma prime (γ') begins to solutionize or dissolve in the superalloy matrix. Thus raising γ' solvus temperatures maintains strength as γ' itself is maintained in the Nickel (Ni)-based superalloy. Thus, it follows that an amount of gamma prime (γ') also is related to Nickel (Ni)-based superalloy strength. Nickel (Ni)-based superalloys can possess a high gamma prime (γ') volume fraction (between about 60 and about 65 volume percent (%) and a high γ' solvus temperature (≥2200° F.)).

Also, Nickel (Ni)-based superalloys as embodied by the disclosure exhibit higher oxidation resistance at gas turbine operating conditions and environments in part due to high aluminum (Al) and Cr contents and low Ti and Mo levels for high temperature oxidation resistance, and high Cr and low Re contents for low temperature oxidation resistance.

Moreover, Nickel (Ni)-based superalloys as embodied by the disclosure herein have low-cycle fatigue (LCF) and creep properties at gas turbine operating conditions and environments in part due to Re, Mo, Ta, tungsten (W) and titanium (Ti).

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise. "Approximately," as applied to a particular value of a range, applies to both end values and, unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application and to enable others of ordinary skill in the art to understand the disclosure for various embodiments with various modifications as are suited to the particular use contemplated.

What is claimed is:

1. A composition consisting essentially of, by weight percent:

Cobalt (Co) between about 4.5 and about 7.0;
Chromium (Cr) between 10.2 and 11.5;
Molybdenum (Mo) between about 0.5 and about 2.5;
Tungsten (W) between about 4.0 and about 5.5;
Rhenium (Re) between 0 and about 1.2;
Aluminum (Al) between 6.2 and 6.8;
Tantalum (Ta) between 4.8 and 5.2;
Titanium (Ti) between 0 and about 0.4;
Hafnium (Hf) between 0 and about 0.5;
Carbon (C) between 0 and about 0.2;
Boron (B) between 0 and about 0.02; and
the balance Nickel (Ni), and other incidental impurities,
wherein by weight percent Molybdenum, Tungsten, Rhenium and Tantalum are related so that (Mo×2)+W+Re+Ta is between about 12.5 and about 15.5.

2. The composition of claim 1, wherein by weight percent:

Cobalt (Co) between about 5.0 and about 7.0;
Chromium (Cr) between 10.2 and 11.5;
Molybdenum (Mo) between about 1.5 and about 1.9;
Tungsten (W) between about 4.0 and about 5.0;
Rhenium (Re) between about 0.5 and about 1.2;
Aluminum (Al) between 6.2 and 6.8;
Tantalum (Ta) between 4.8 and 5.2;
Titanium (Ti) between 0 and about 0.4;
Hafnium (Hf) between 0 and about 0.5;
Carbon (C) between 0 and about 0.2;
Boron (B) between 0 and about 0.02; and
the balance Nickel (Ni), and other incidental impurities.

3. The composition of claim 1, wherein by weight percent:

Cobalt (Co) 6.2;
Chromium (Cr) 10.5;
Molybdenum (Mo) 1.9;
Tungsten (W) 4.7;
Rhenium (Re) 1.0;
Aluminum (Al) 6.4;
Tantalum (Ta) 5.0;
Titanium (Ti) 0.3;
Hafnium (Hf) 0.14;
Carbon (C) 0.04;
Boron (B) 0.004; and
the balance Nickel (Ni), and other incidental impurities.

4. The composition of claim 1, wherein by weight percent, the composition includes about 20 ppm of one or more rare earth elements.

5. The composition of claim 1, wherein by weight percent, the composition includes about Sulfur (S) less than 1 ppm.

6. The composition of claim 1, wherein the composition includes by weight percent: rare earth or lanthanide elements content up to about 20 ppm.

7. A composition consisting essentially of, by weight percent:

Cobalt (Co) between about 5.9 and about 6.5;
Chromium (Cr) between about 10.3 and about 11;
Molybdenum (Mo) between about 1.75 and about 1.95;
Tungsten (W) between about 4.5 and about 4.9;
Rhenium (Re) between about 0.9 and about 1.1;
Aluminum (Al) between 6.25 and 6.5;
Tantalum (Ta) between 4.8 and 5.2;
Titanium (Ti) between about 0.2 and about 0.4;
Hafnium (Hf) between about 0.1 and about 0.2;
Carbon (C) between about 0.03 and about 0.1;
Boron (B) between about 0.003 and about 0.01; and
the balance Nickel (Ni), and other incidental impurities.

8. The composition of claim 1, wherein by weight percent:

Cobalt (Co) between about 4.5 and about 5.0;
Chromium (Cr) between 10.2 and 11.5;
Molybdenum (Mo) between about 2 and about 2.5;
Tungsten (W) between about 4 and about 5;
Rhenium (Re) 0;
Aluminum (Al) between 6.2 and 6.8;
Tantalum (Ta) between 4.8 and 5.2;
Titanium (Ti) between 0 and about 0.4;
Hafnium (Hf) between 0 and about 0.5;
Carbon (C) between 0 and about 0.2;
Boron (B) between 0 and about 0.02; and
the balance Nickel (Ni), and other incidental impurities.

9. The composition of claim 1, wherein by weight percent:

Cobalt (Co) 5.0;

Chromium (Cr) 10.5;
Molybdenum (Mo) 2.4;
Tungsten (W) 4.5;
Rhenium (Re) 0;
Aluminum (Al) 6.6;
Tantalum (Ta) 5.2;
Titanium (Ti) 0.1;
Hafnium (Hf) 0.15;
Carbon (C) 0.04;
Boron (B) 0.004; and
the balance Nickel (Ni), and other incidental impurities.

10. The composition of claim 1, wherein by weight percent:
Cobalt (Co) between about 4.7 and about 5.0;
Chromium (Cr) between about 10.3 and about 11;
Molybdenum (Mo) between about 2.2 and about 2.5;
Tungsten (W) between about 4.2 and about 4.7;
Rhenium (Re) 0;
Aluminum (Al) between 6.5 and 6.7;
Tantalum (Ta) between 4.8 and 5.2;
Titanium (Ti) between 0 and about 0.2;
Hafnium (Hf) between about 0.1 and about 0.2;
Carbon (C) between about 0.03 and about 0.1;
Boron (B) between about 0.003 and about 0.01; and
the balance Nickel (Ni), and other incidental impurities.

11. The composition of claim 1, wherein by weight percent:
Cobalt (Co) between about 5.0 and about 7.0;
Chromium (Cr) between 10.2 and 11.5;
Molybdenum (Mo) between about 0.5 and about 1.5;
Tungsten (W) between about 4.5 and about 5.5;
Rhenium (Re) between about 0.5 and about 1;
Aluminum (Al) between 6.2 and 6.8;
Tantalum (Ta) between 4.8 and 5.2;
Titanium (Ti) between 0 and about 0.4;
Hafnium (Hf) between 0 and about 0.5;
Carbon (C) between 0 and about 0.2;
Boron (B) between 0 and about 0.02; and
the balance Nickel (Ni), and other incidental impurities.

12. The composition of claim 1, wherein by weight percent:
Cobalt (Co) 6.6;
Chromium (Cr) 10.8;
Molybdenum (Mo) 0.8;
Tungsten (W) 5.0;
Rhenium (Re) 0.8;
Aluminum (Al) 6.4;
Tantalum (Ta) 5.2;
Titanium (Ti) 0.1;
Hafnium (Hf) 0.15;
Carbon (C) 0.04;
Boron (B) 0.004; and
the balance Nickel (Ni), and other incidental impurities.

13. The composition of claim 1, wherein by weight percent:
Cobalt (Co) between about 6.4 and about 6.8;
Chromium (Cr) between about 10.6 and about 11.0;
Molybdenum (Mo) between about 0.7 and about 0.9;
Tungsten (W) between about 4.8 and about 5.2;
Rhenium (Re) between about 0.7 and about 0.9;
Aluminum (Al) between 6.25 and 6.55;
Tantalum (Ta) between 4.8 and 5.2;
Titanium (Ti) between 0 and about 0.2;
Hafnium (Hf) between about 0.1 and about 0.2;
Carbon (C) between about 0.03 and about 0.1;
Boron (B) between about 0.003 and about 0.01; and
the balance Nickel (Ni), and other incidental impurities.

14. A composition consisting essentially of, by weight percent:
Cobalt (Co) 6.2;
Chromium (Cr) 10.5;
Molybdenum (Mo) 1.9;
Tungsten (W) 4.7;
Rhenium (Re) 1.0;
Aluminum (Al) 6.4;
Tantalum (Ta) 5.0;
Titanium (Ti) 0.3;
Hafnium (Hf) 0.14;
Carbon (C) 0.04;
Boron (B) 0.004; and
the balance Nickel (Ni), and other incidental impurities.

15. An article of manufacture, the article including a composition, the composition consisting essentially of by weight percentage:
Cobalt (Co) 6.2;
Chromium (Cr) 10.5;
Molybdenum (Mo) 1.9;
Tungsten (W) 4.7;
Rhenium (Re) 1.0;
Aluminum (Al) 6.4;
Tantalum (Ta) 5.0;
Titanium (Ti) 0.3;
Hafnium (Hf) 0.14;
Carbon (C) 0.04;
Boron (B) 0.004; and
the balance Nickel (Ni), and other incidental impurities.

16. The article of manufacture of claim 15, wherein the article includes a turbomachinery hot gas path component selected from the group including one or more of: turbine blades; turbine nozzles; casings; housings; compressor parts; shrouds; vanes; diaphragms; and combustion liners, parts, and transition pieces.

17. A method of making an article, the method comprising:
forming a nickel based alloy, the nickel based alloy consisting essentially of, in weight percent:
Cobalt (Co) 6.2;
Chromium (Cr) 10.5;
Molybdenum (Mo) 1.9;
Tungsten (W) 4.7;
Rhenium (Re) 1.0;
Aluminum (Al) 6.4;
Tantalum (Ta) 5.0;
Titanium (Ti) 0.3;
Hafnium (Hf) 0.14;
Carbon (C) 0.04;
Boron (B) 0.004; and
the balance Nickel (Ni), and other incidental impurities, and forming the article from the nickel based alloy.

18. The method of claim 17, wherein forming the article includes forming a turbomachinery hot gas path component, the turbomachinery hot gas path component selected from the group including one or more of: turbine blades; turbine nozzles; casings; housings; compressor parts; shrouds; vanes; diaphragms; and combustion liners, parts, and transition pieces.

* * * * *